US006425456B1

(12) United States Patent
George

(10) Patent No.: US 6,425,456 B1
(45) Date of Patent: Jul. 30, 2002

(54) HOLLOW SEMICIRCULARLY CURVED LOUDSPEAKER ENCLOSURE

(75) Inventor: Jacob George, Los Angeles, CA (US)

(73) Assignee: Vector Transworld Corporation, Los Angeles, CA (US)

( * ) Notice: Subject to any disclaimer, the term of this patent is extended or adjusted under 35 U.S.C. 154(b) by 84 days.

(21) Appl. No.: 09/614,405

(22) Filed: Jul. 12, 2000

(51) Int. Cl.[7] ..... A47B 81/06

(52) U.S. Cl. ..... 181/199; 181/155; 181/160; 181/182

(58) Field of Search ..... 181/199, 152, 181/153, 155, 156, 159, 160, 163, 165, 182, 185, 187, 189, 192, 193, 194; 381/339, 340, 341, 160, 161; D14/204, 210

(56) References Cited

U.S. PATENT DOCUMENTS

| | | | | | |
|---|---|---|---|---|---|
| 1,477,554 | A | * | 12/1923 | Grissinger | |
| 2,852,089 | A | * | 9/1958 | Cohen et al. | 181/31 |
| 3,993,162 | A | * | 11/1976 | Juuti | 181/156 |
| 4,225,010 | A | * | 9/1980 | Smith | 181/155 |
| 4,655,315 | A | * | 4/1987 | Saville | 181/153 |
| 4,811,816 | A | * | 3/1989 | Lin | 181/160 |
| 4,853,964 | A | * | 8/1989 | Weckler | 381/156 |
| 4,876,723 | A | * | 10/1989 | Fang | 381/182 |
| 4,965,839 | A | * | 10/1990 | Elieli | 381/195 |
| 5,220,608 | A | * | 6/1993 | Pfister | 381/17 |
| 5,373,564 | A | * | 12/1994 | Spear et al. | 381/160 |
| 5,742,696 | A | * | 4/1998 | Walton | 381/156 |
| 6,222,929 | B1 | * | 4/2001 | Kim | 381/182 |

FOREIGN PATENT DOCUMENTS

| | | | | |
|---|---|---|---|---|
| DE | 3242722 A1 | * | 5/1984 | 181/199 |
| JP | 52004817 A | * | 1/1977 | 181/156 |

* cited by examiner

*Primary Examiner*—Robert E. Nappi
*Assistant Examiner*—Edgardo San Martin
(74) *Attorney, Agent, or Firm*—Maria Erlinda C. Sarno

(57) ABSTRACT

A loudspeaker enclosure having an improved full range driver and an improved enclosure assembly. The enclosure assembly comprise a hollow semicircularly curved internal and external casing thereby forming semicircular external baffles; a series of interconnected flat baffles forming an internal baffle placed inside the hollow semicircularly curved casing, the series of flat baffles peripherally bordered by the hollow semicircularly curved casing and enclosed with side panels to form a circuitous labyrinth of a constantly increasing cross section, the labyrinth subsequently splitting and terminating into an exit port for each split pathway, the side panels together with the hollow semicircularly curved casing forming the enclosure's external walls; a compression chamber inside the cylindrical top of the semicircularly curved casing behind the driver, the compression chamber having a back open end facing a sloping back semicircular wall to allow sound waves coming from the driver to travel down the labyrinth and prevent back waves from reflecting back to the driver; and, a base unit for holding and stabilizing the enclosure.

27 Claims, 17 Drawing Sheets

HOLLOW SEMICIRCULARLY CURVED LOUDSPEAKER ENCLOSURE

BACKGROUND

The invention relates to an enclosure of a loudspeaker that preserves the bandwidth and output efficiency, naturalness and tonality of presentation.

A loudspeaker is a final element in a chain between a person and the sound that person desires to hear. As such, a loudspeaker must overcome many limitations to produce even reasonable musical fidelity. A loudspeaker transforms an incoming electrical signal to an acoustical signal that is processed by one's ears and brain. The human ear is capable of receiving and interpreting signals over a wide range of frequencies, 20 to 20,000 Hertz (Hz). For a loudspeaker to sound natural, it must faithfully reproduce signals throughout this entire range. The major problem facing every loudspeaker designer is that the brain is an extremely sensitive instrument and has an uncanny ability to distinguish between the sound produced by a loudspeaker and that of the original instrument. The designer is also faced with having little or no control over the environment into which the loudspeaker will ultimately be placed. A loudspeaker normally comes in two units which can be placed anywhere in space at the discretion of the owner or listener.

Most speakers today typically comprise of two or more drivers which reproduce differing segments of the frequency spectrum; a crossover which splits up incoming frequencies and sends each select portion to an appropriately designed driver; and, a speaker enclosure which is a key element in a speaker's sonic signature, and without which the bass frequencies will not be reproduced. This invention, however, is directed to an enclosure housing of what is known as a "full range driver", wherein there is just one driver and no crossovers. A full range driver means that it reproduces the entire audible range of frequency.

The preferred driver used for the claimed invention is the full range LOWTHER driver made commercially available by the LOWTHER Loudspeaker Systems, Kent, England such as the LOWTHER Dx, C and A series. This driver has a manufacturer claimed frequency response of 30 Hz–22 KHz, a sensitivity of 97 db/w/m (decibel/watt/meter) which when attached to the claimed enclosure goes well over 100 db/w/m and utilizes an ultra-light paper cone that gives it very high response speed which translate into crisper, clearer sound reproduction. The basic principle of operation involves sending a signal from a system's amplifier through a speaker's voice coil, a thin cylindrical wound wire which is attached to a thin cylinder connected to the speaker's cone or dome. This voice coil is suspended in a magnetic field wherein a signal current in the suspended coil creates another magnetic field that interacts with the already existing field, causing the coil and the cone attached to it to vibrate. This vibration produces the sound. The LOWTHER driver used in conjunction with the claimed enclosure, as stated above, is a crossoverless loudspeaker. There are no electronics in the signal path between the amplifier and the transducer, also known as the driver, because it uses a single, full range voice coil driver which reproduces the entire aural spectrum. The claimed invention also improves on the LOWTHER driver by adding a third cone between the original two cones of the series of LOWTHER drivers used herein. As purchased, the LOWTHER full-range driver forrows a dual-cone, single voice typology, that is, there is a main cone and a smaller cone, commonly called a whizzer cone, that attaches concentrically to the main cone both of which are connected to a single voice coil. A third cone is proposed herein because most drivers with this dual cone configuration suffer from an elevated, meaning too much energy, in the upper midrange to lower treble frequencies (between 2 khz and 8 khz). This elevated energy is believed to be due to the waves produced by the main cone interacting or intermodulating with the waves produced by the whizzer cone. By introducing another cone in between these two cones, intermodulation does not occur specially in this crucial region. A loudspeaker's enclosure has a tremendous influence on the reproduced sound. Vibrations in an enclosure or cabinet combine with the driver's output to produce the sound heard by the listener. A poorly designed cabinet enclosing the finest drivers will produce a mediocre speaker/loudspeaker at best. The fundamental function of the enclosure is to deal with the rear or back wave of the driver. Rear wave and back wave are interchangeably used herein. The driver is a diaphragm that moves forward and backwards when fed with an electrical signal. Therefore, the rear wave produced is identical to the front wave, except that it is phase-reversed by 180 degrees. The enclosure needs to either deaden and absorb the rear wave or it needs to alter the rear wave in such a manner that cancellations between the front and rear waves do not occur. Cancellations limits the bandwidth and output efficiency of the driver. The environment around the driver is also important for the speed, detail, transparency and soundstaging characteristics of the loudspeaker. Consequently, the present invention also addresses the volume of space directly behind the driver but before the labyrinth, the pathway through which the sound waves travel before it exits to the outside environment. The volume of space directly behind the driver is referred to herein as the compression chamber. The volumetric proportions and geometric configuration of the compression chamber is crucial to the quality of the sound produced. The claimed invention addresses the geometric configuration of the compression chamber. When a rear wave from the driver first enters the compression chamber before exiting through an opening referred to herein as throat, the waves hit the surface facing it. If this surface is flat, the rear waves will be reflected back to the driver resulting in loss of sound clarity. The claimed invention designed a compression chamber having a cylindrical cross section to address this. The compression chamber holds the driver in one end with the other end facing a curved surface sloping down at approximately 45 degrees from the longitudinal axis of the cylinder, to direct all sound waves down into the labyrinth instead of being reflected back to the driver. Additionally, the materials from which an enclosure is built is also important because an understanding of the effect of vibrations on the surface of the material makes the designer able to correlate these with the sounds they produce.

There are many types of enclosures, most of which try to cancel out, enclose or deaden the rear waves. The claimed enclosure is a "horn-loaded" enclosure. Unlike the other enclosures that try to cancel or deaden the rear or back wave, this type of enclosure uses the back waves to the fullest, in a controlled manner depending upon the basic performance characteristics of the driver used. With LOWTHER drivers, the bass frequencies are channeled through the rear such that these are actually amplified instead of deadened when it comes out of the openings in the enclosure. While adopting the principles of a horn-loaded enclosure, the claimed invention did away with the traditional horn-load design principles and geometries. Traditional horn loaded enclosure uses flat sided boxes or enclosures which induces various colorations or sound distortion caused by a series of resonances produced by the reflection of the sound waves. The parallel-sided box which is the most common enclosure configuration, is prone to several deficiencies both as a result of the back wave acting on it internally and the front waves reflecting off its front external surface. Both these phenomena contribute to the "muddying" or distortion of the reproduced sound. These colorations are usually mollified but not eliminated by the use of bracing, damping or absorbing materials and massively heavy enclosures. The claimed invention uses several curved elements in the enclosure to eliminate coloration instead of ameliorating a created coloration.

It is an object of this invention to provide an enclosure that is designed to avoid coloration by eliminating completely any back wave reflections re-impacting the driver.

It is also an object of this invention to provide an enclosure that eliminates standing waves within the enclosure, thereby preventing box coloration.

It is also an object of this invention to provide an enclosure design that eliminates performance degrading baffle reflections and edge diffraction.

It is a further object of this invention to provide an enclosure which minimizes secondary box/enclosure/cabinet vibrations.

It is also a further object of the invention to improve the current two-cone full range drivers for better quality sound reproduction.

SUMMARY OF THE INVENTION

The present loudspeaker enclosure invention overcomes the problems of conventional horn-loaded loudspeakers such as coloration by eliminating standing sound waves within the enclosure and reflected sound waves off the enclosure re-impacting the driver; baffle reflection by having a curved front baffle surface; and, secondary cabinet vibration.

The loudspeaker enclosure meeting the objects of the invention is an assembly comprising of a hollow semicircularly curved casing having a cylindrical top, the cylindrical top having an open front end for introducing a driver thereto and a back end connecting to a first end of a sloping back semicircular side, the back semicircular side having a second end connected to a first end of a semicircular bottom surface, the semicircular bottom surface having a second end connected to a first end of a front semicircular side, the front semicircular side having a second end connecting to the front end of the cylindrical top thereby forming a semicircular front baffle of the enclosure; a series of interconnected flat baffles forming an internal baffle placed inside the hollow semicircularly curved casing, the series of flat baffles peripherally bordered by the hollow semicircularly curved casing and enclosed with side panels forming a labyrinth, an enclosed circuitous pathway of a constantly increasing cross section, the labyrinth subsequently splitting and terminating into an exit port for each split pathway, the side panels together with the hollow semicircularly curved casing forming the enclosure's external walls; a compression chamber inside the cylindrical top of the semicircularly curved casing behind the driver, the compression chamber having a back open end facing the sloping back semicircular side to allow sound waves coming from the driver to travel down the labyrinth and prevent back waves from reflecting back to the driver; and, a base unit for holding and stabilizing the enclosure. The series of flat baffles are typically interconnected by gluing the individual baffles to each other to form the internal baffle of the enclosure which is in turn connected in an air tight manner to the side panels and the semicircularly curved casing by use of gaskets and sealants. The loudspeaker enclosure is assembled with the use of tie rods, tie rod cap nuts, gaskets and washers and is leveled with level adjuster spike and adjustable top bolts.

The invention also proposes the addition of an add-on cone to stock LOWTHER drivers to ameliorate certain energy peaks produced by the LOWTHER driver in the region between 2.5 kHz to 8 kHz.

BRIEF DESCRIPTION OF THE DRAWING

These and other objects and advantages of the present invention will become more readily apparent upon reading the following Detailed Description and upon reference to the attached drawings, in which.

DETAILED DESCRIPTION OF THE INVENTION

Figure 1:
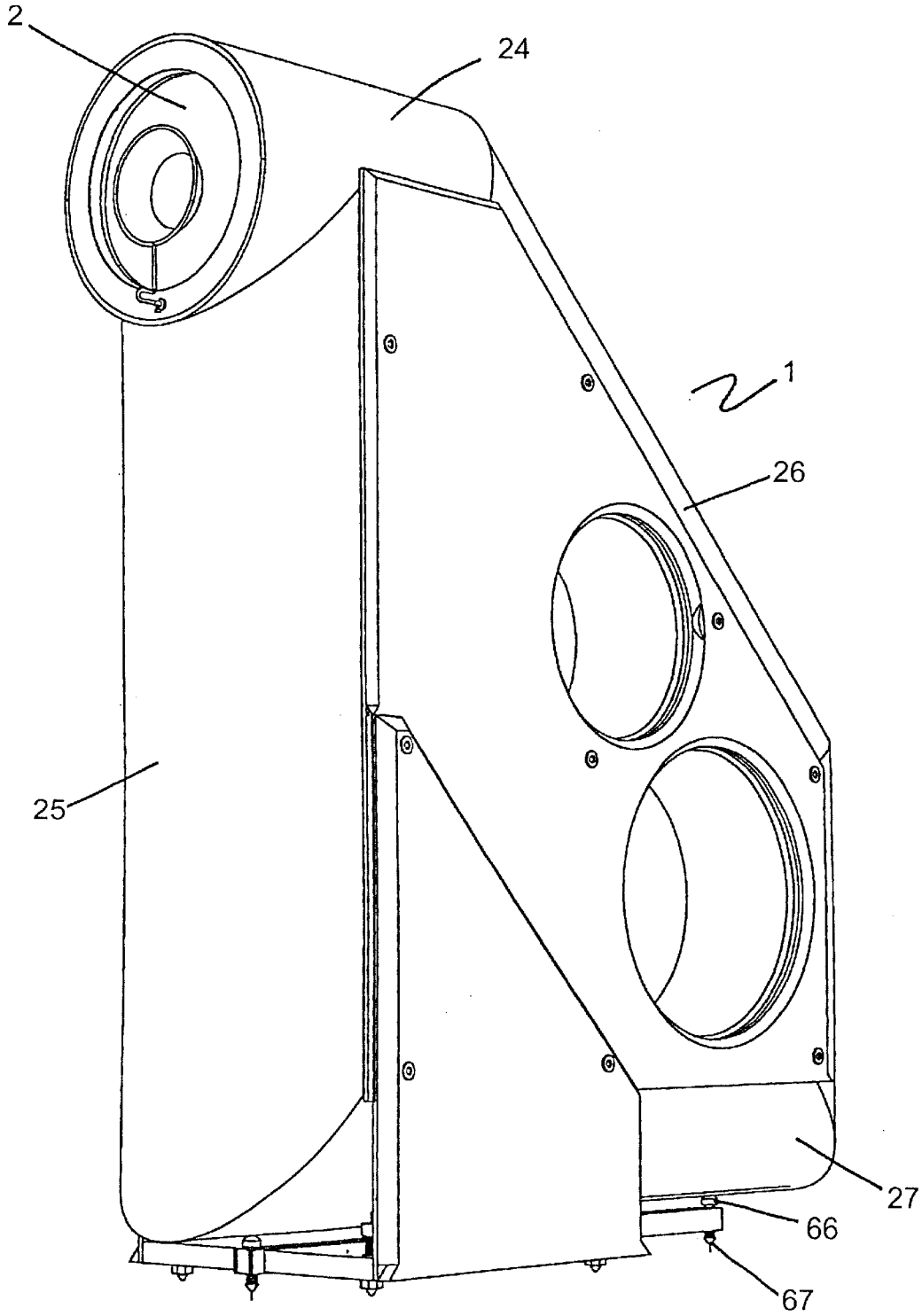
FIG. 1 is a perspective view of the loudspeaker enclosure.
Figure 2:
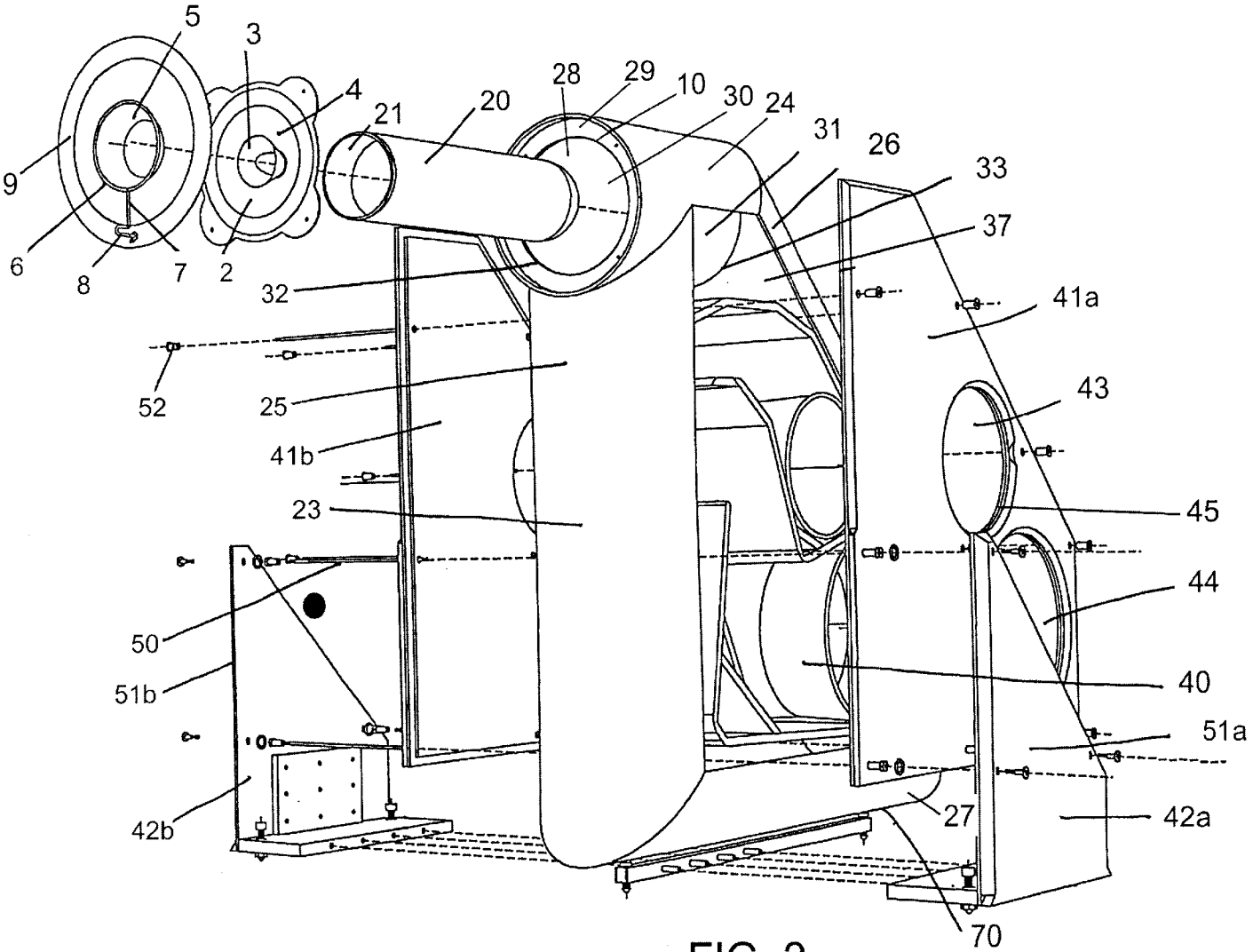
FIG. 2 is an exploded view showing the components of the loudspeaker enclosure.

The claimed loudspeaker enclosure 1, herein also simply referred to as enclosure, is designed herein to take a full range driver 2 and preferably a LOWTHER driver but the concept and design of the loudspeaker enclosure can be applied to other types or brand of full range drivers. The loudspeaker enclosure 1 of this invention is shown in FIG. 1. The interconnection of the parts comprising the enclosure and the location where the driver 2 attaches to the enclosure is shown in FIG. 2. While the loudspeaker enclosure 1 is the claimed invention, the invention also proposes an improvement on the drivers that are used with the loudspeaker enclosure 1 for better sound quality which will be described first. The claimed enclosure, however, can be used with unimproved drivers which, although inferior in sound quality compared to those with the improved drivers, will still produce a sound superior to the conventional horn loaded loudspeaker enclosures.

Figure 3:
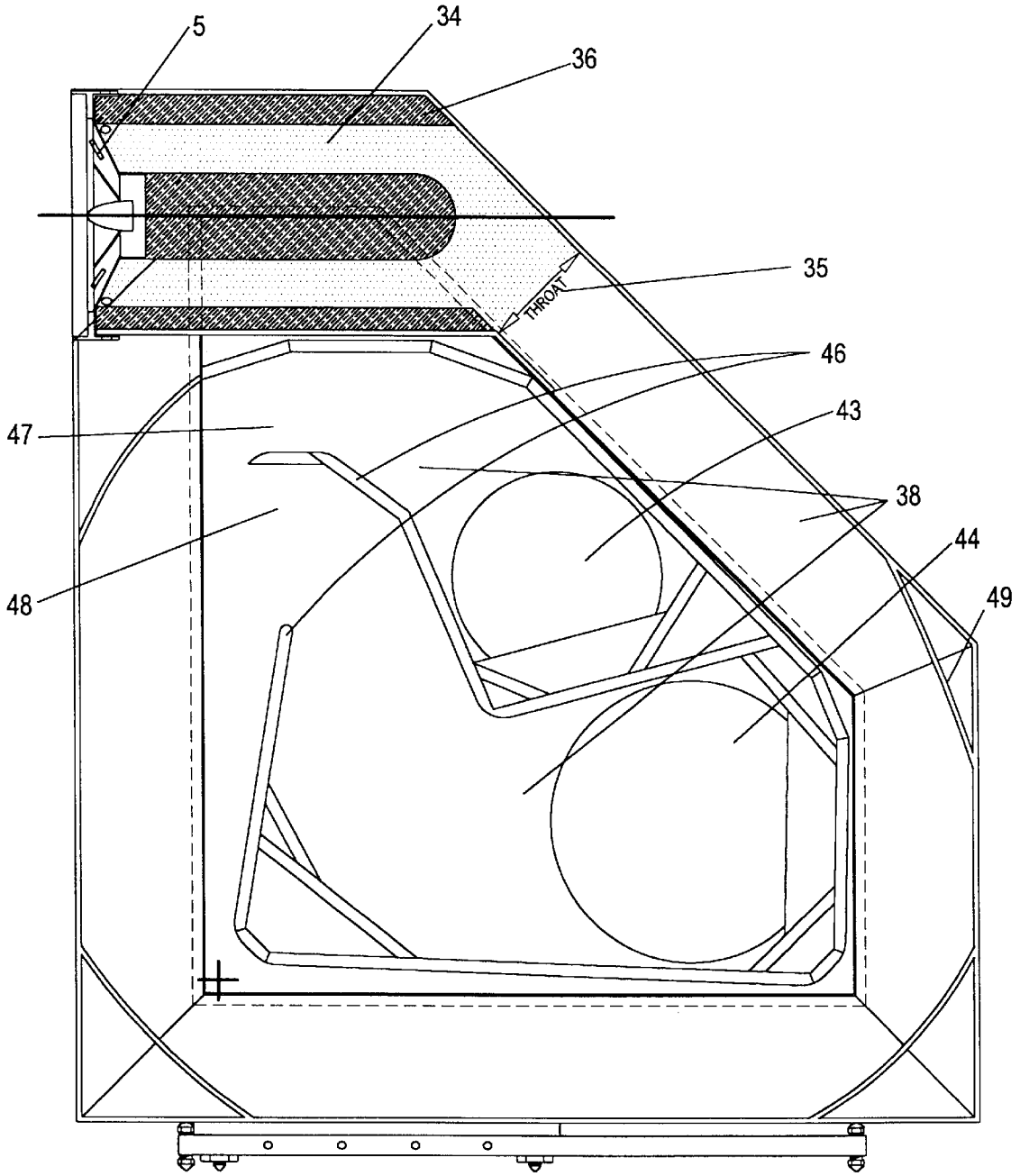
FIG. 3 is a side view showing the driver attached to the compression chamber of the enclosure.
Figure 3A:
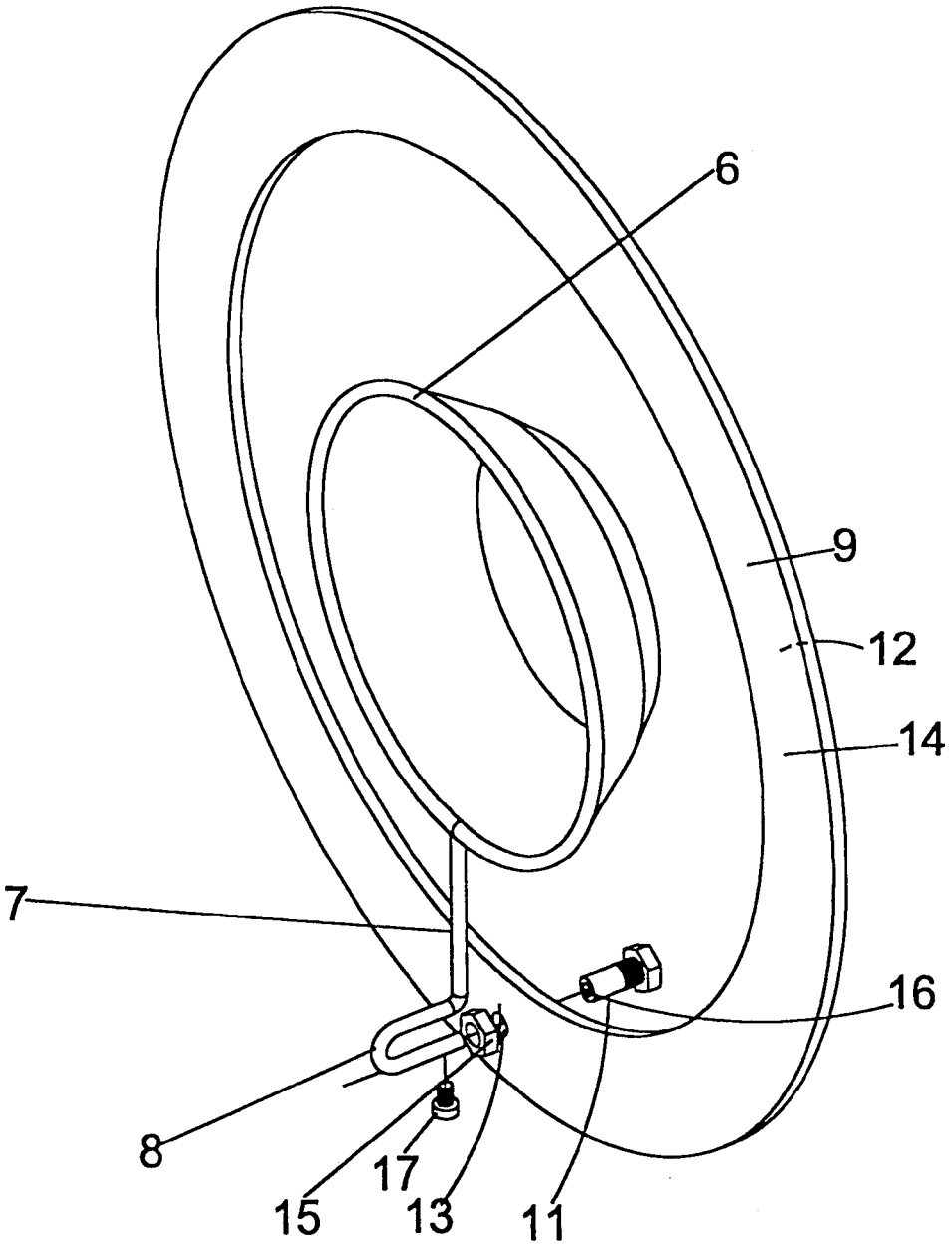
FIG. 3A is a perspective view of the add-on cone assembly.
Figure 3B:
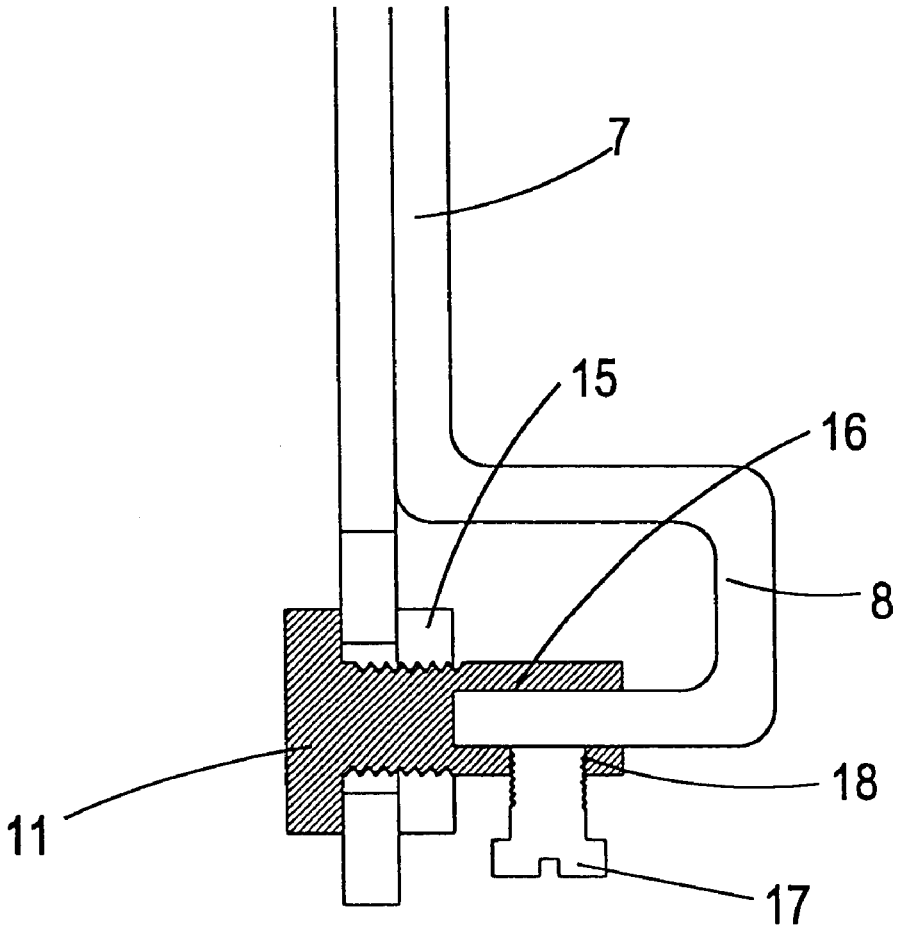
FIG. 3B is a side view of the add-on cone showing the details of how the cone is attached to the acrylic ring.

The commercially available LOWTHER driver used herein has a whizzer cone 3 in front of a main cone 4. The sound waves created by the whizzer cone 3 and the main cone 4 interact with each other, that is, the rear wave of the whizzer cone and the front wave of the main cone interact with each other creating intermodulary anomalies in the sound. To solve this problem, the claimed invention incorporates a third cone, an add-on cone 5 between the whizzer cone and the main cone as shown in FIG. 3 which by virtue of its position, eliminates intermodulation, thereby smoothing the sound, particularly ameliorating the increase in loudness noticed in the upper midrange and lower treble frequencies between 2 kHz and 8 kHz. The add-on cone 5 is stuck onto a round shaped stainless steel armature 6 with glue such as a rubber glue and placed between the cones of the LOWTHER driver in such a manner that the add-on cone 5 does not touch either the whizzer or the main cone. The details of the attachment and introduction of the third cone between the two cones are shown in FIGS. 3, 3A and 3B. The add-on cone is a truncated cone, cut and molded from a thin flat sheet, preferably made of foam rubber or polyfoam, having a thickness no greater than 2 mm. Slits are cut at the narrower or smaller end 19 of the cone, preferably eight in number. This material is particularly suited because it is thin, absorbent and can easily hold its conical shape. The armature 6 is supported by a support rod 7 with a bent tip 8 on the end away from the cone. This bent tip of the support rod goes into a special bolt that is attached onto an acrylic ring 9. The acrylic ring 9 is stuck to the flanges 10 of the driver 2 after the driver has been bolted to the enclosure 1. The special bolt 11 goes from the inner side 12 of the acrylic ring facing the driver, through a hole 13 and out to the outer side 14 of the acrylic ring where it is fastened by a nut 15 at the outer side 14 of the acrylic ring. The special bolt 11 has a hole 16 running through its center, into which the bent tip 8 of the support rod 7 is inserted into. A check screw 17 is introduced through a hole 18 perpendicular to the axis of the special bolt 11 to hold the armature 6, and consequently the add-on cone 5 in place.

At the rear of the driver 2 is a magnet casing (not shown). An expanded cylinder 20 (hereinafter referred to as inner cylinder) is attached onto the magnet casing by means of a sleeve 21 that is cast into the cylinder. This sleeved end of the cylinder slips onto the magnet casing and is then taped in place. The rear end 22 of this expanded cylinder is closed. This inner cylinder 20 is preferably made of polystyrene because of the ease of casting polystyrene, its extreme light weight, and its low cost.

The driver 2 or the improved driver described above is inserted into the enclosure 1. The main component of the enclosure 1 is a casing 23 which forms the perimeter of the loudspeaker enclosure 1 shown independently in FIG. 4 and shown with the driver 2 in FIGS. 1 and 2. It is preferably made of fiberglass. While fiberglass is preferred for the casing 23, these can also be made of metal, wood, and plastic material so long as they can be shaped into the form shown in FIGS. 1, 2 and 4 with the required strength and rigidity found in the fiberglass material. Fiberglass is preferably used for ease of molding, high strength to thickness ratio, high strength to weight ratio and relative cost efficiencies. The fiberglass enclosure is molded as a single unit by methods known in the art. The interior of the casing 23 is hollow, having a cylindrical top 24, a front semicircular surface or side 25, a back semicircular surface or side 26 and a semicircular bottom surface 27. The front, back and bottom surfaces consequently also have semicircular internal walls formed from the semicircularly curved surfaces or external walls of the casing 23. The front semicircular side 25 forms the front baffle of the enclosure and because of its curved surface, disperses all reflected waves from the front face of the driver thereby eliminating secondary reflection problems which are currently brought about by an enclosure with a flat front face into which the driver is fitted instead of the curved surface proposed herein. Secondary reflective problems are brought about when the driver is fitted into an enclosure with a flat face because the flat surface acts as a reflective surface for the sound waves radiating from the driver which consequently gets directed to the listeners, thus distorting the clarity and soundstaging abilities of the loudspeaker or speaker. Additionally, the flat front face also acting as a baffle, may also vibrate thereby setting up wave-fronts of their own that are beamed directly at the listener.

Figure 5:
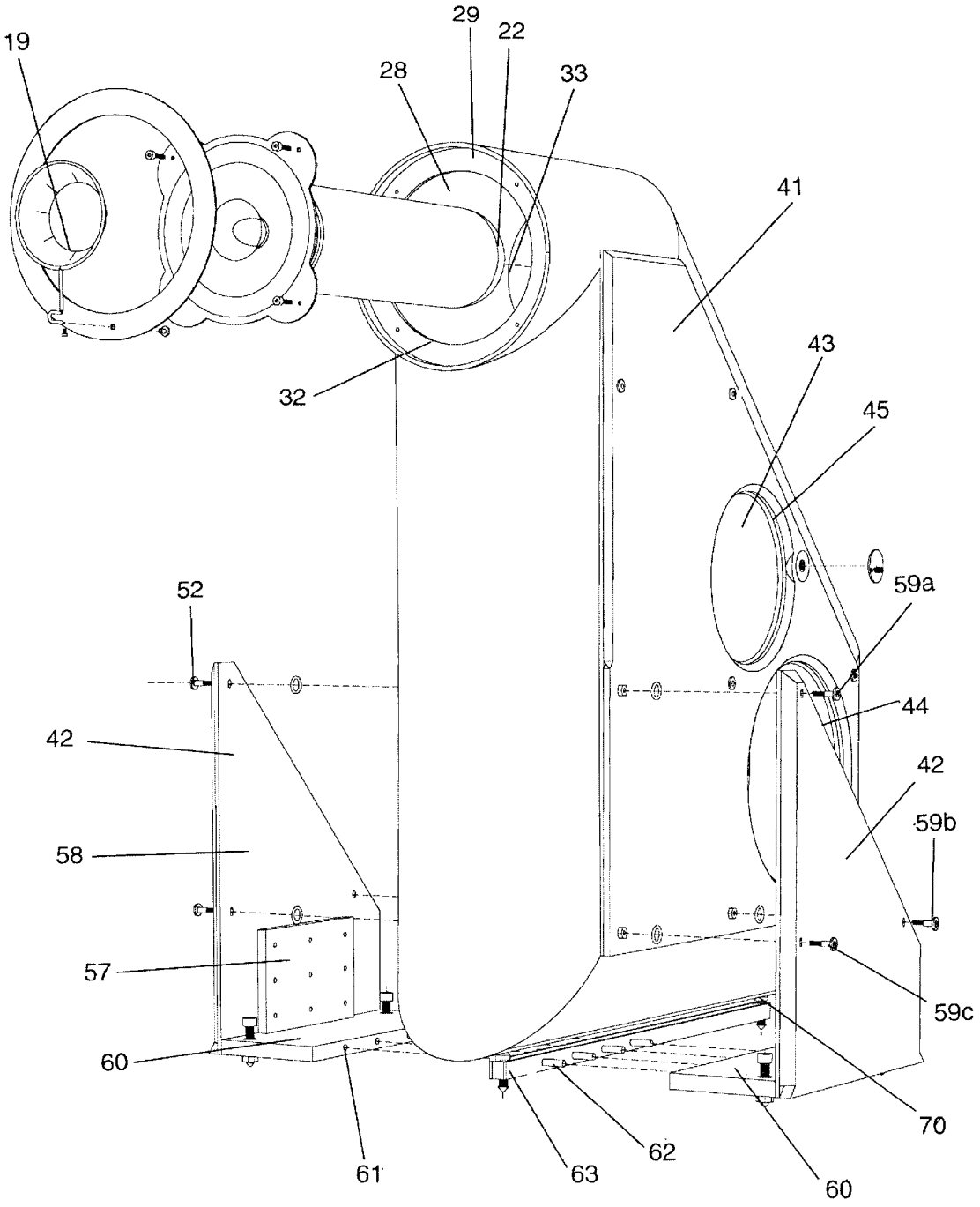
FIG. 5 is a perspective view of the loudspeaker enclosure with the base unit detached.
Figure 6:
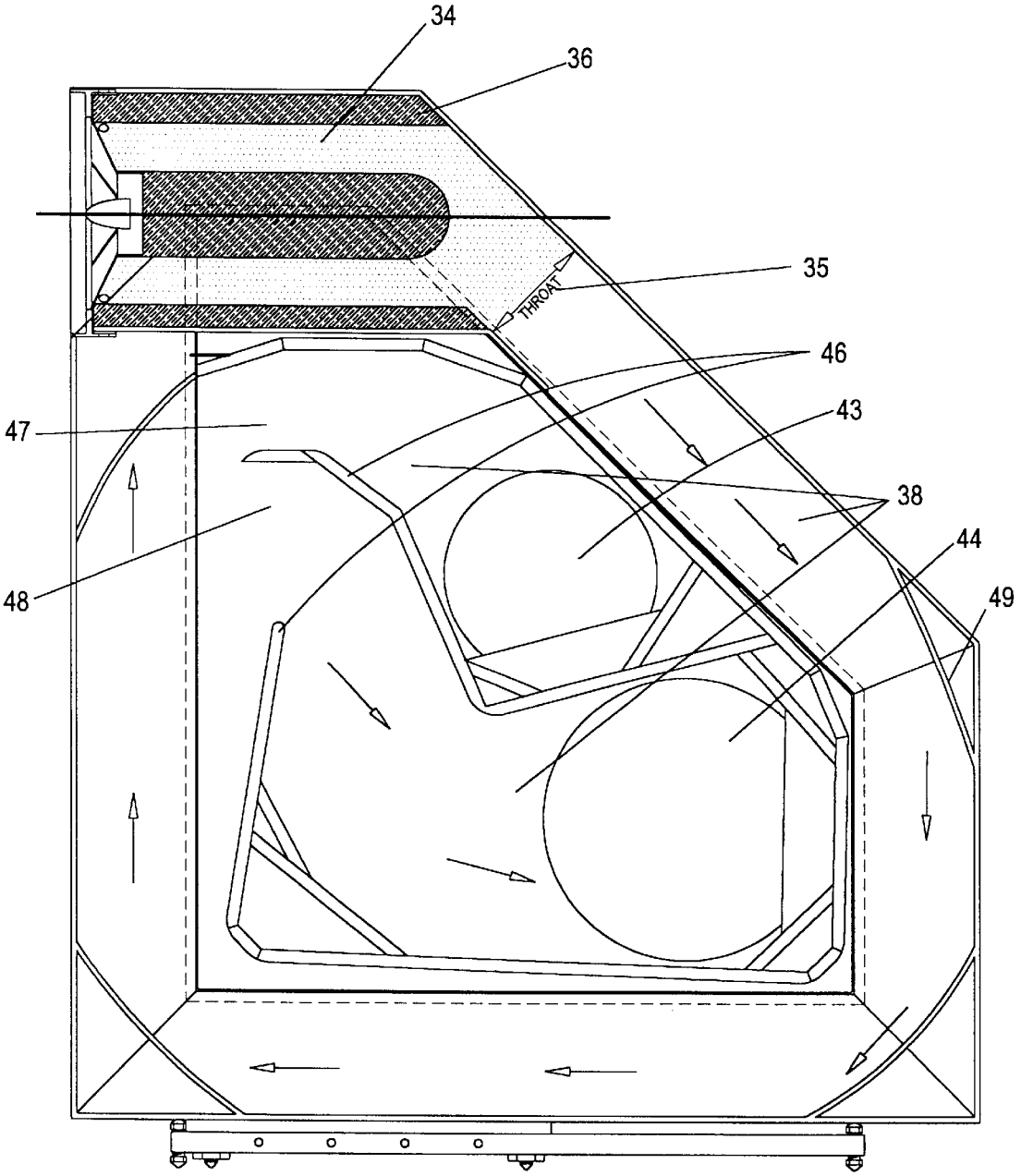
FIG. 6 is a side view showing the labyrinth inside the semicircularly curved casing with the arrows showing the direction of the sound waves.

The cylindrical top 24 has an opening 28, a front opening facing the environment through which the driver 2 attaches. The front opening 28 has a circular flange 29 protruding from its top peripheral edge. Behind the flange 29 and inside the wall 30 of the cylindrical top 24 of the enclosure 1 is cast, a second cylinder 31, also preferably made of polystyrene of a greater diameter than the inner cylinder 20 as shown in FIG. 2. This second cylinder 31, hereinafter referred to as outer cylinder, has a front end 32 and a rear end 33. The driver 2 now having attached at its rear, the inner cylinder 20, is inserted into the cylindrical top end 24 of the enclosure and bolted to the circular flange 29 protruding from the top peripheral edge of the front opening 28 of the cylindrical top end 24 as shown in FIG. 5. The outer cylinder 31 and the inner cylinder 20 are concentric to each other after the above attachment as shown in FIGS. 3 and 6. The volume of space behind the driver 2, between the inner cylinder 20 and the outer cylinder 31 is called the compression chamber 34. Behind the outer cylinder 31, the cylindrical top end 24 begins to slope at approximately 45 degrees into the back semicircular side 26. This point at which it starts to slope is called the throat 35. The purpose of the inner cylinder 20 and the outer cylinder 31 which may be lined 36 with the same material is to reduce the volume of the compression chamber 34. The outer cylinder 31 used for the enclosure example shown in FIGS. 12–15 is approximately one inch thick while the diameter of the inner cylinder is approximately 4 inches. It is important for both the diameter of the inner cylinder and the outer cylinder to be variable because the upper cut-off frequency of the back or rear waves can be adjusted according to the formula: $c \times At(2 \times pi \times V)$=upper cut-off frequency, where c=speed of sound, At is the throat area and V is the volume of the compression chamber 34. Since C is a constant and At is measurable for a given enclosure, V is the variable that can be adjusted for a given desired upper cut off frequency.

The wall behind the driver and the compression chamber, the interior wall of the back semicircular side 37, is also semicircular or curved and slanted as shown in FIGS. 2 and 3. The curved surface, unlike a flat surface, prevents the back waves from the driver from reflecting back to the driver once these hit the interior wall 37. A rear wave reflecting back to the driver causes disturbances on the driver which results in a loss of clarity and undesirable enhancement or depletion of certain frequencies due to intermodulation. The curved surface also prevents standing waves which are waves that get reflected back and forth like a light between two parallel mirrors. The sloped curved surface of the interior wall 37 further directs the sound waves coming from the compression chamber 34 down to a labyrinth 38 through the throat 35. The labyrinth 38 is the internal pathway through which the sound waves travel, as shown by arrows in FIG. 6, through the enclosure 1 before it exits an opening or openings to the outside as shown in FIGS. 2, 3 and 6.

The casing or fiberglass casing 23 together with the side panels 41*a* and 41*b* and base units 42*a* and 42*b* form the external enclosure or walls of the loudspeaker. The side 41 and base 42 units are made of wood, preferably plywood, specially pressed plywood. On each of the side panels 41*a* and 41*b* are two openings 43 and 44 through which the sound waves exit from as shown in FIG. 5. Around the openings are armatures 45 preferably made of stainless steel framework for wrapping cloth onto. The cloth mesh, which may be of any kind that is "porous" or transparent to sound, preferably net-like, is used as a screen to cover the labyrinth 38 from being seen through the openings from the outside and to provide the enclosure, a neat finished appearance.

The labyrinth 38 is made up of a series of flat baffles 46. These baffles are cut into individual pieces of a specified dimension and placed together, interconnected, by gluing the joints of the individual pieces, preferably with wood glue, and reinforcing these joints with nails. These glued pieces of flat baffles of a design and construction that can only be accurately described by looking at FIGS. 2,3 and 6 will be referred to herein as the internal baffle 40. The internal baffle 40 is preferably made of medium density fiberboard but other materials such as plywood or solid wood planks can also be used. The internal baffle 40 is placed inside the casing 23 as shown in FIG. 2. Once inserted, this and the external borders, a portion of the cylindrical top end 24, the front semicircular side 25, the back semicircular side 26 and the semicircular bottom surface 27 forms the labyrinth 38, a circuitous enclosed pathway through which the sound waves travel as shown in FIG. 6. To prevent leakage of sound waves from one portion of the labyrinth to another, the edges 39 of the internal baffles are bordered around with polyfoam or rubber gaskets and sealed to the side panels 41*a* and 41*b* and the sides 39*a* of the internal baffles touching and facing the casing 23 are likewise sealed the same way with the casing. The labyrinth 38, as shown in FIG. 6, starts behind the compression chamber 34, through the throat 35, down the slope through the back, bottom and front semicircular sides and then branches to two entrances 47 and 48 facing the interior wall 25*a* of the front semicircular side or front panel 25 of the casing 23. The sound waves enter and split its path, one portion of the split wave entering 47, exiting through opening 43 and the other portion entering 48, exiting through 44. Once the sound waves enter the split entrances, the sound waves travel through a path shaped like a slide which is L-shaped. Within the labyrinth, at each corner or turning point of the path bordered by the semicircular sides 25, 26, and 27, are reflecting pieces 49 preferably made of fiberglass to direct the sound waves into the following segment of the labyrinth and to ensure that the cross sectional area is maintained.

The labyrinth controls the path and the specific path length of the sound waves before exiting the enclosure. To produce the lowest frequencies, the length of the labyrinth has to be very long therefore requiring a very large enclosure. The path of the labyrinth 38 is designed such that its cross section is constantly increasing as it gets closer to the exit ports or openings 43 and 44 to produce the amplification of the sound in a similar manner as the tubing of a trumpet as shown in FIGS. 2,3 and 6. An example of the enclosure, with dimensions shown in FIGS. 12–15, fulfill the requirements of the path length and the increase in cross section and at the same time design an enclosure with a good compromise between sound quality and size acceptability. In this example, the sound waves are made to travel a path length of approximately 9.5 feet for one split portion of the sound waves and approximately 11 feet for the other portion of the sound waves before they exit the ports. The shape of the labyrinth 38, like the internal baffle 40, can only be accurately described by looking at FIGS. 2,3 and 6.

Figure 4:
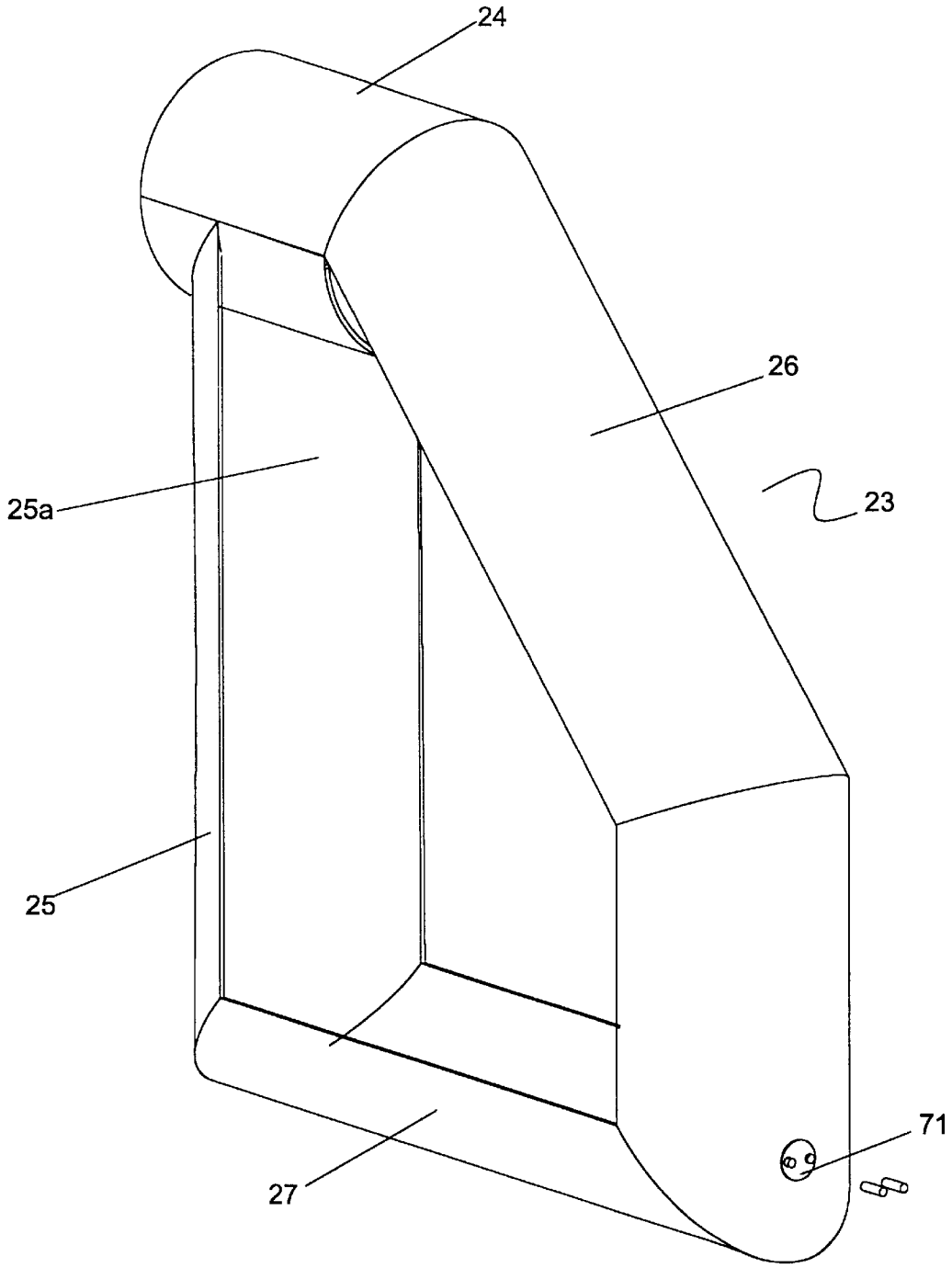
FIG. 4 is a perspective rear view of the semicircularly curved enclosure casing.
Figure 7:
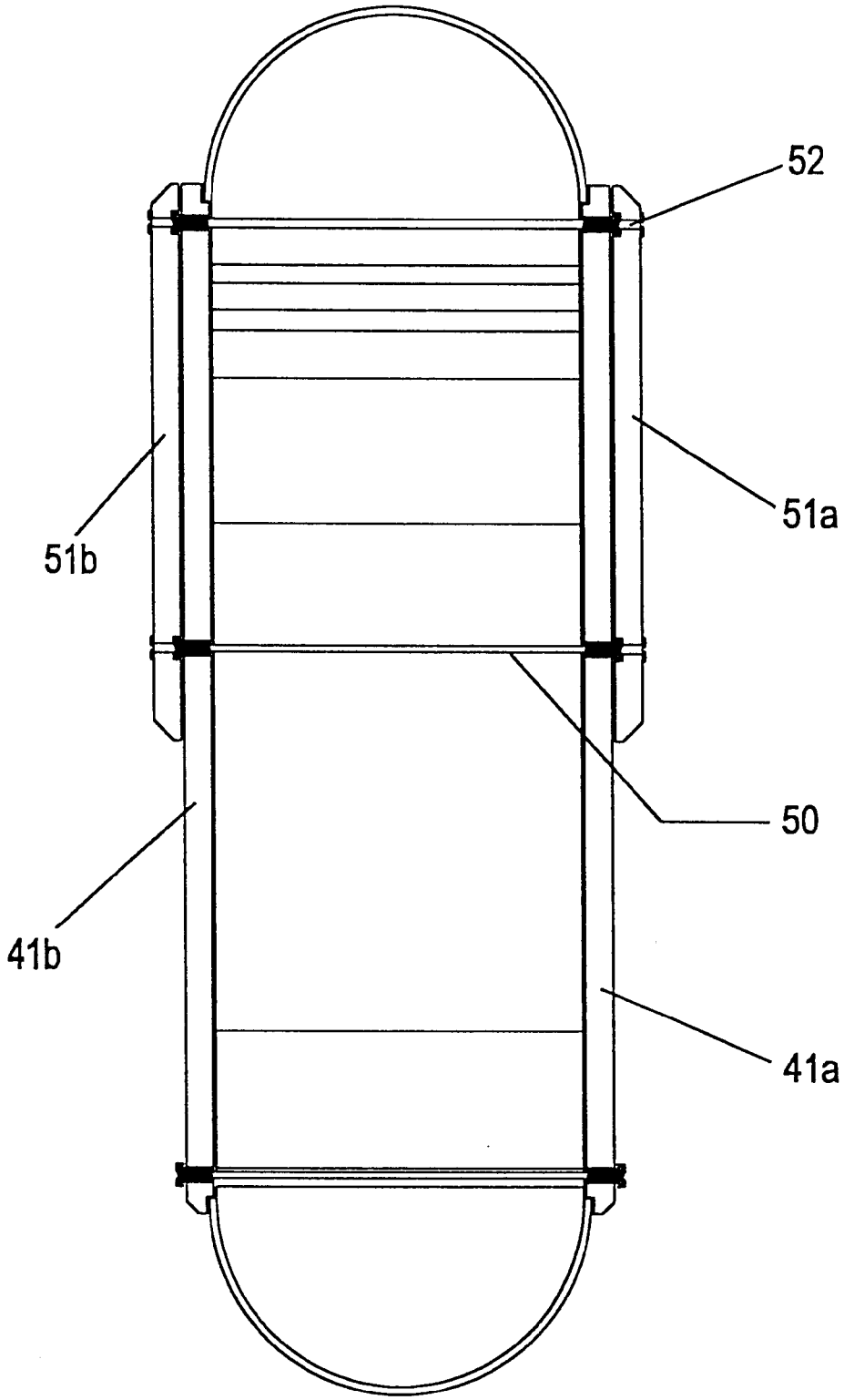
FIG. 7 is a cross sectional view showing the location of the tie rods supporting the loudspeaker enclosure.
Figure 8:
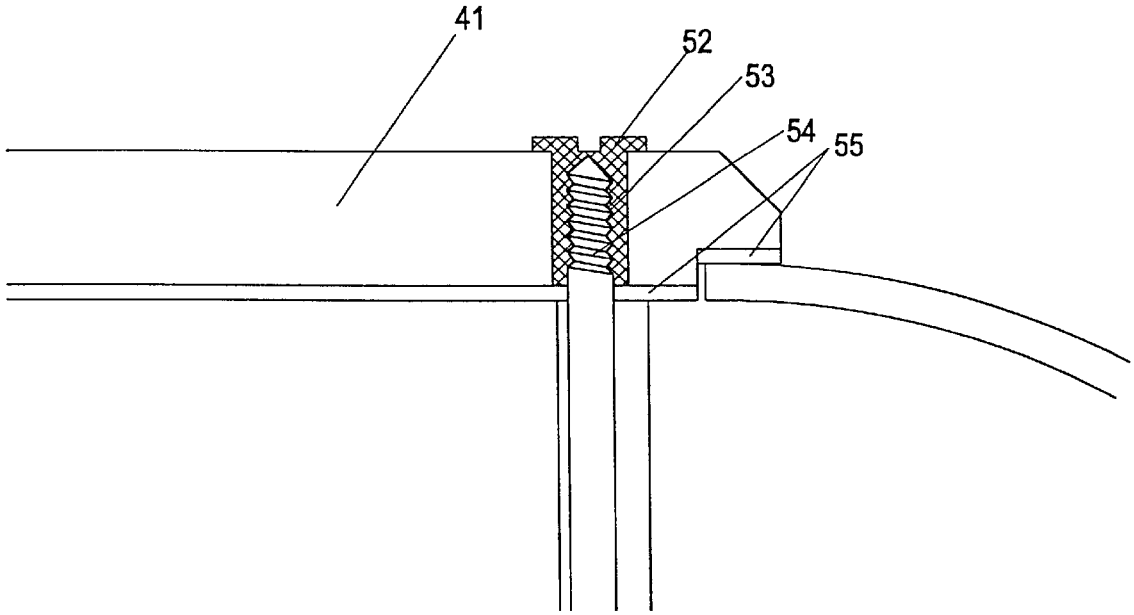
FIG. 8 is a cross sectional view detailing the interconnection of the side panel with the fiberglass enclosure casing.
Figure 9:
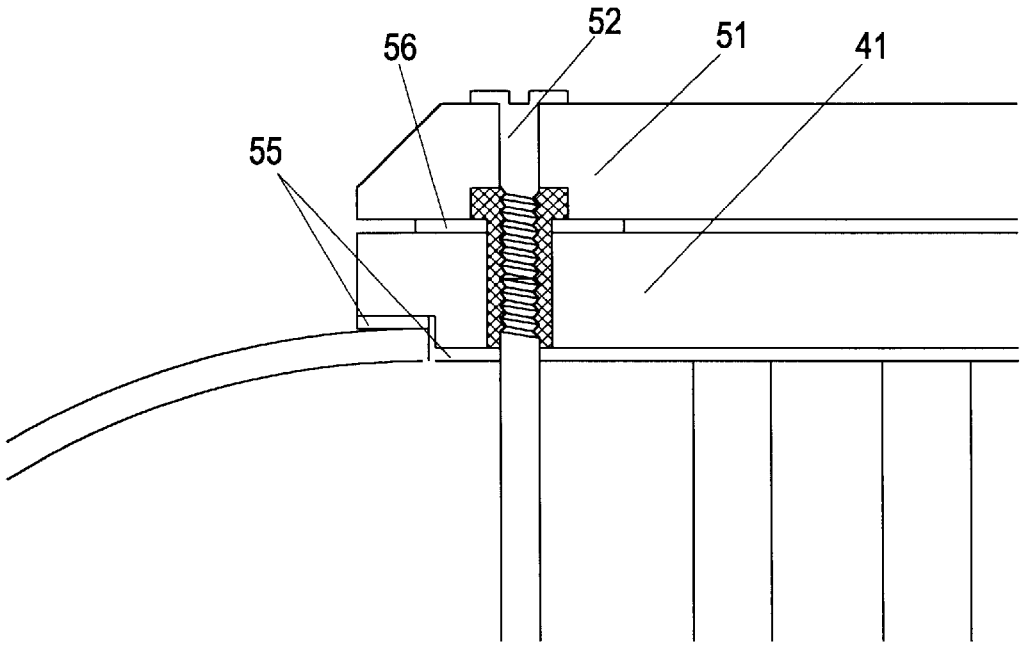
FIG. 9 is a cross sectional view detailing the interconnection of a base unit with a side panel.
Figure 10:
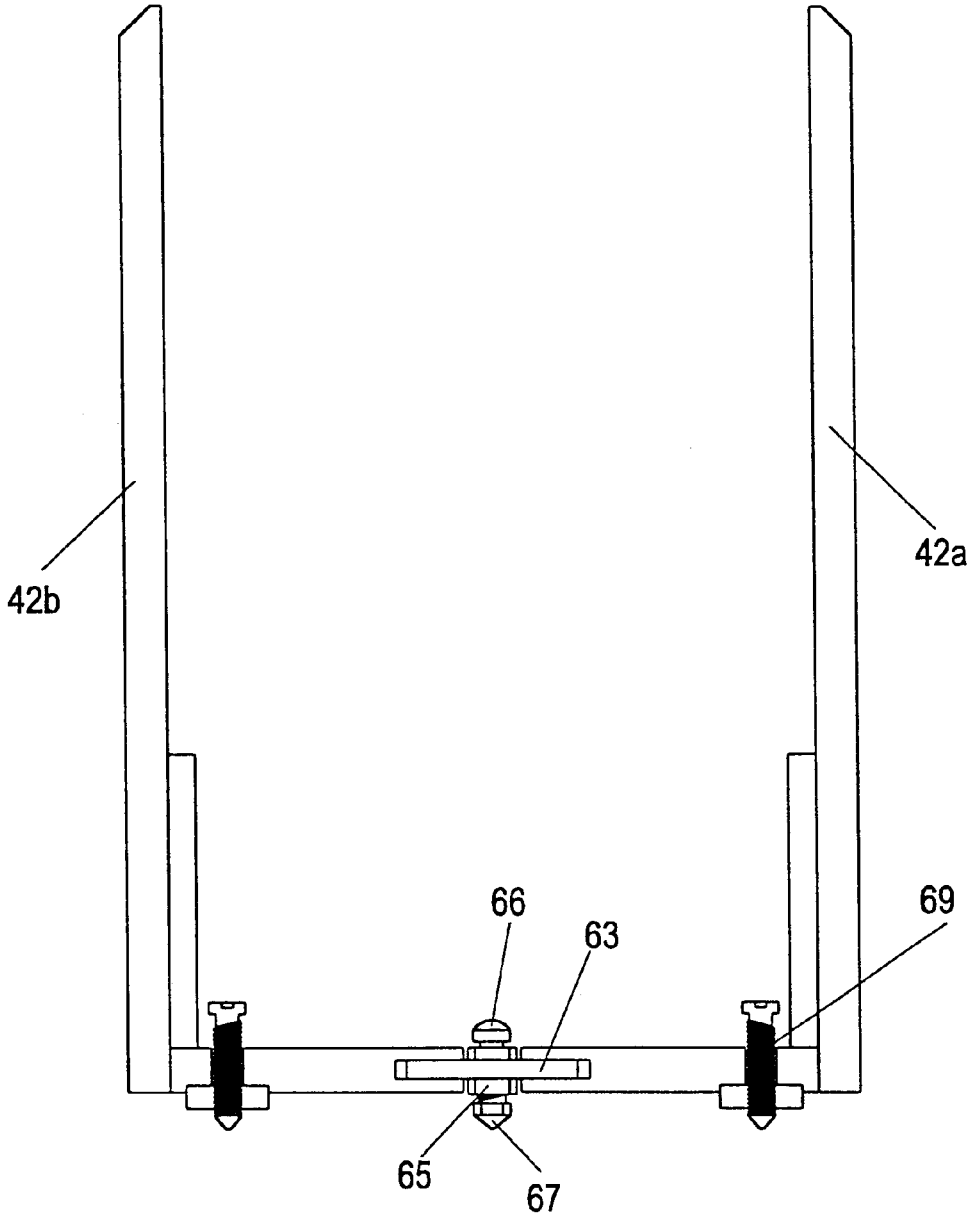
FIG. 10 shows how the studs or pins connect to the transverse panels of the base unit.
Figure 11:
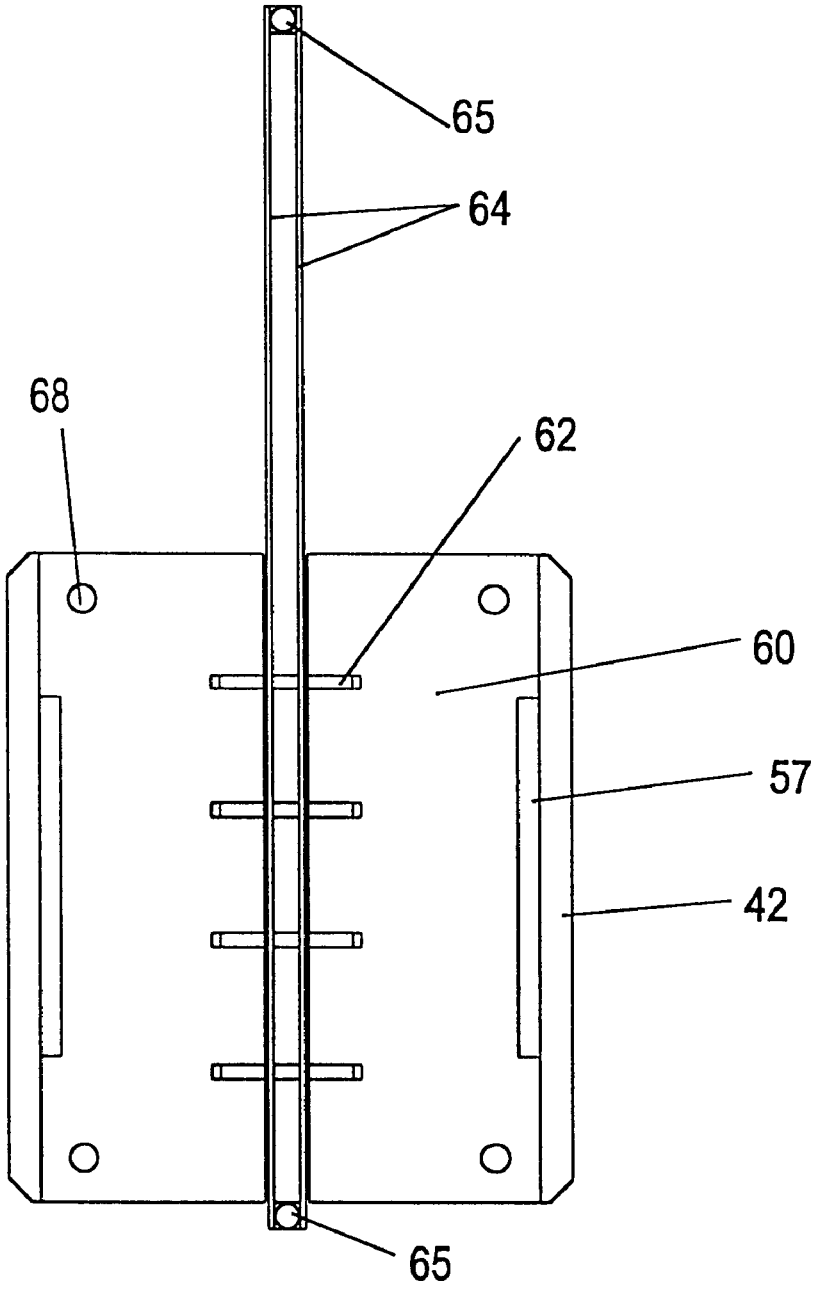
FIG. 11 is a top plan view showing the base connector and shell support assembly connecting the two base units.
Figure 12:
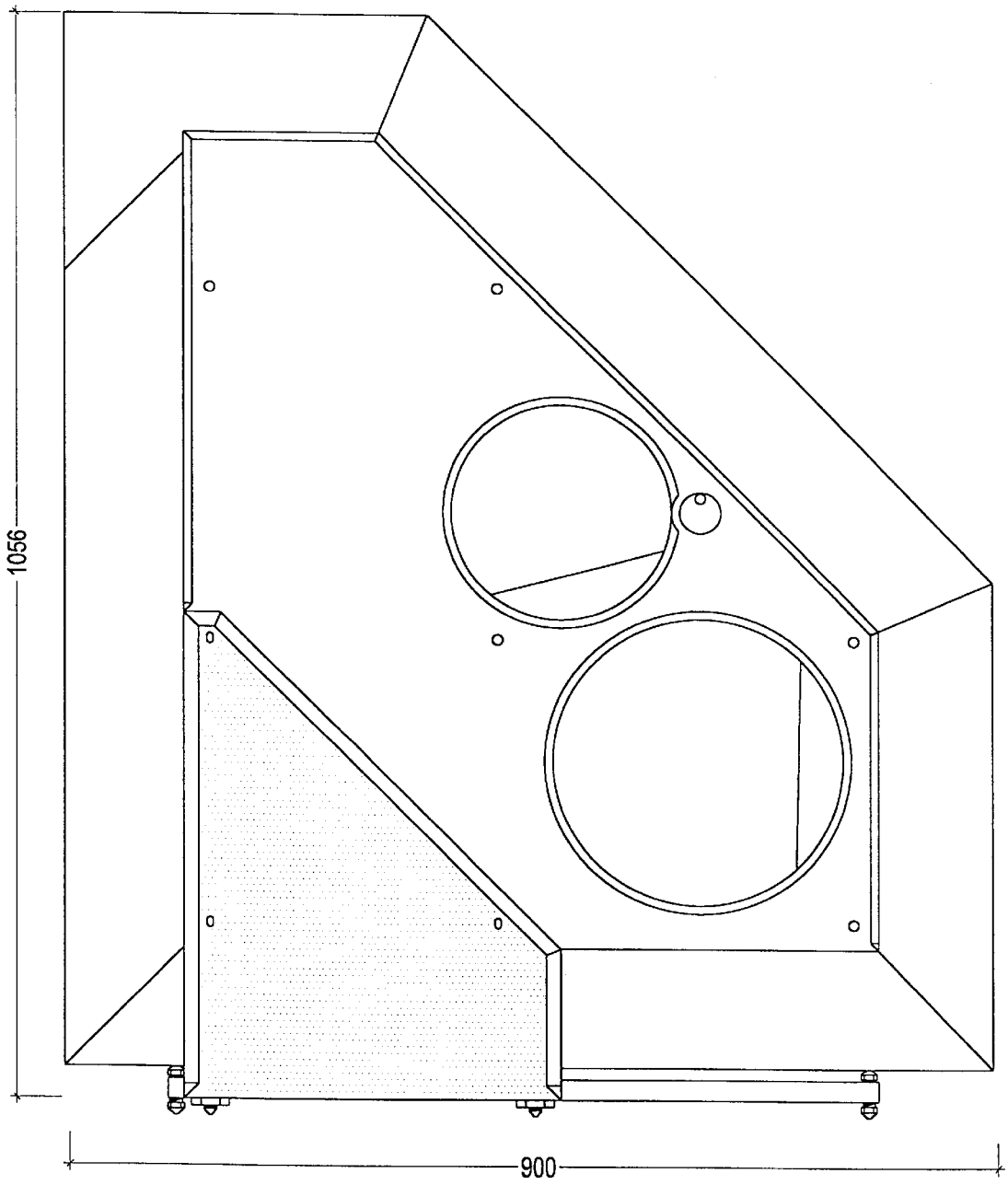
FIGS. 12–15 shows the main dimensional details measured in millimeter of an example of a loudspeaker enclosure.
Figure 13:
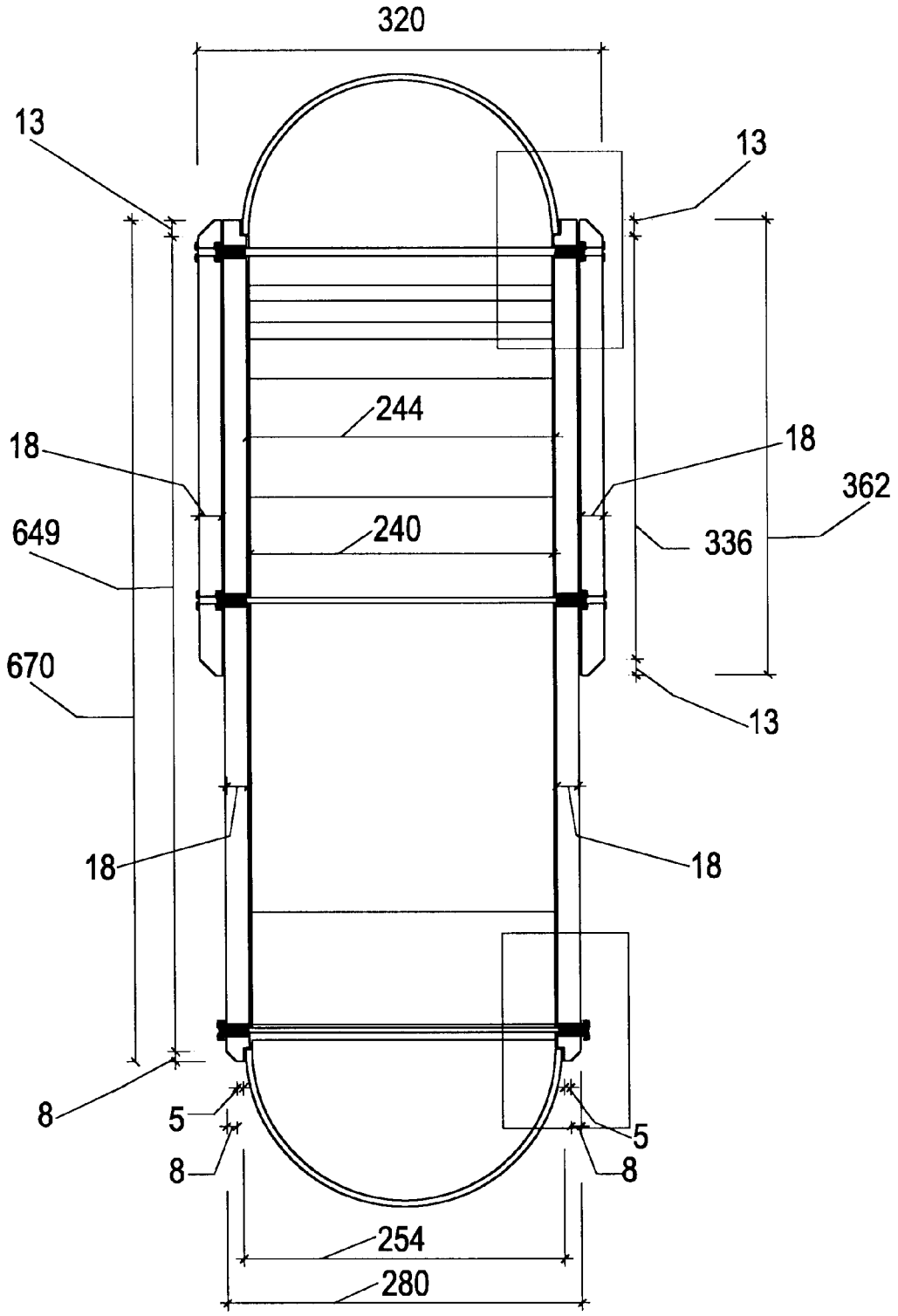
Figure 14:
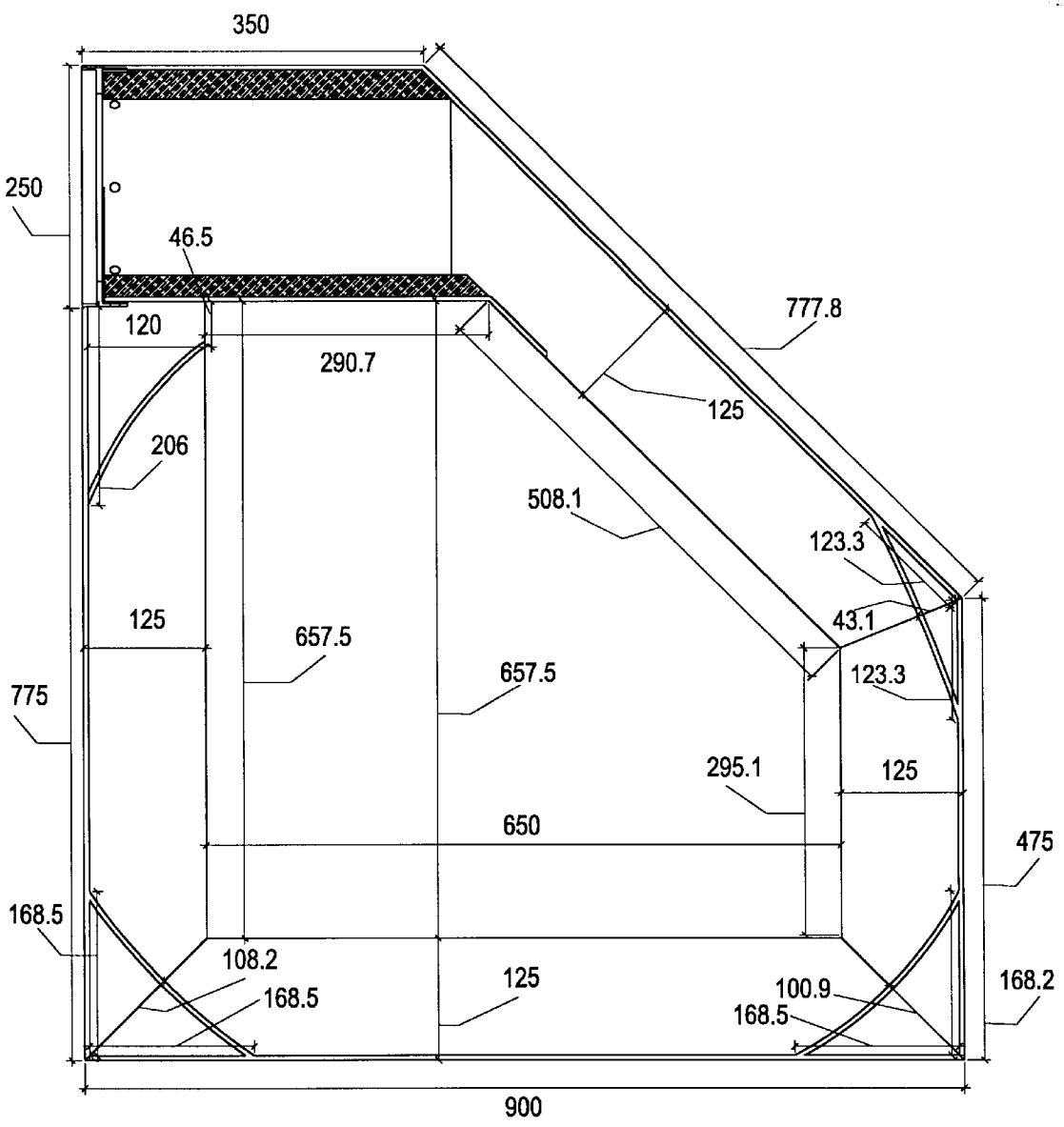
Figure 15:
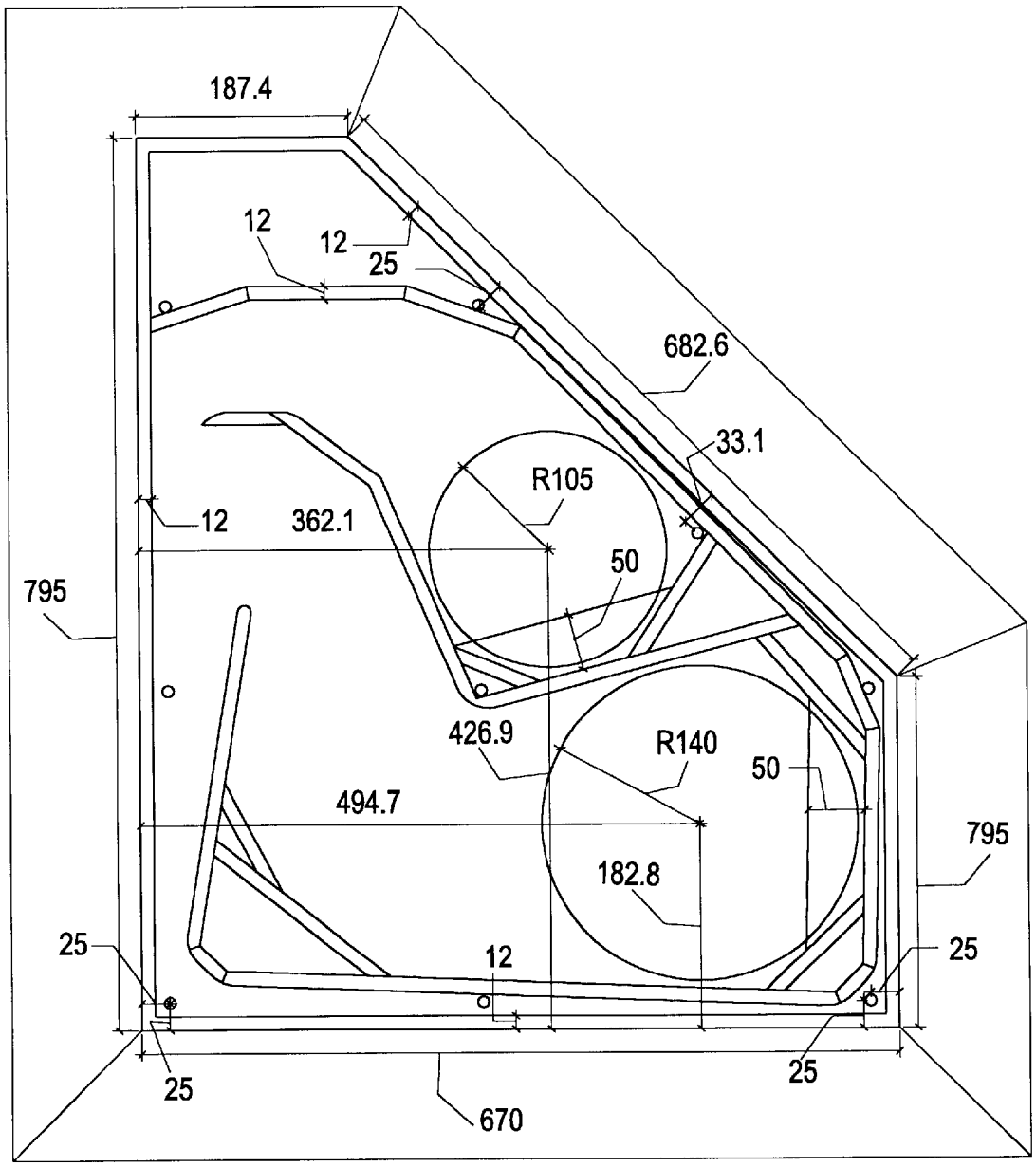

The tie rods 50 hold the entire assembly together as shown in FIG. 2. These rods 50 goes through either from one side of the side panel 41*a* to the other side of the side panel 41*b* or from an external side wall 51*a* of the base unit 42*a* to the other external side wall 51*b* of the base unit 42*b*. Tie rod cap nuts 52 having a threaded sleeve 53 receives the tie rod's external ends 54. These cap nuts are tightened to keep the tie rods in place and seal the side panels against the casing to form a perfectly airtight enclosure. FIGS. 7 and 8 show the detail of how the tie rods 50 fasten the respective side panels 41 and on FIG. 9, the side walls 51 with the enclosure's casing 23. Polyfoam gaskets 55 placed between the side panels 41 and the enclosure casing 23 create the airtight seal. A washer 56 is typically placed between the side panels 41*a* and 41*b* and the respective internal walls 58 of the side walls 51. A rectangular piece of plywood 57 is screwed on the internal surface 58 of the respective side walls 51 of the base unit 42 such that the side panels 41 of the main enclosure rest on the rectangular inserts 57. This is done so that the substantial weight of the enclosure is efficiently and safely transferred to the rectangular inserts 57 of the base unit 42, without excessively stressing the 3 small bolts 59*a, b*, and *c* that attach the base unit to the enclosure. The base unit 42 holds the enclosure upright and standing. It is made of two units, 42*a* and 42*b* so that the gap at the center between the two transverse bottom panels 60 can vary to suit minor differences in the overall width of the unit, in the order of approximately 1 mm, that may arise during the assembly of the enclosure. The transverse bottom panels 60 of the base unit 42 has openings 61 for receiving the studs or pins 62 of the base connector and shell support assembly 63, hereinafter referred to as bs assembly, as shown in FIGS. 2, 5 and 10. The bs assembly 63 connects the two units 42*a* and 42*b* of the base unit through this connection to enable the two separate units to act as a single composite unit. FIG. 11 is a top plan view showing this connection and the following description. The assembly is made up of two longitudinal rectangular pieces 64 of preferably stainless steel material having on both opposite ends, a threaded block 65 also preferably of stainless steel material, for receiving an adjustable top bolt 66 and an adjustable bottom bolt 67. This bs assembly can also be tubular in shape. As shown in FIGS. 10 and 11,on the inner sides of each transverse panels 60 of the base units 42*a* and 42*b* are two openings or holes 68, for a total of four for each enclosure 1, to accommodate a base level adjuster spike 69 with pointed ends and adjustable height to level the loudspeaker. After leveling of the speaker with the adjuster spikes 69, the adjustable top bolt 66 of bs assembly 63 is adjusted to contact the base 70 of the enclosure casing 23 while the bottom bolt 67 is adjusted to spike into the floor. The bs assembly limits possible vibrations of the enclosure casing 23. The speaker terminals 71 may be mounted at the back of the casing as shown in FIG. 4.

An example of a loudspeaker enclosure detailing its main dimensions in millimeters is shown in FIGS. 12–15.

While the embodiments of the present invention have been described, it should be understood that various changes, adaptations, and modifications may be made therein without departing from the spirit of the invention and the scope of the claims.

What is claimed is:

1. A loudspeaker enclosure, comprising:

a hollow semicircularly curved casing having a cylindrical top, the cylindrical top having an open front end for introducing a driver thereto and a back end connecting to a first end of a sloping back semicircular side, the back semicircular side having a second end connected to a first end of a semicircular bottom surface, the semicircular bottom surface having a second end connected to a first end of a front semicircular side, the front semicircular side having a second end connecting to the front end of the cylindrical top thereby forming a semicircular front baffle of the enclosure;

a series of interconnected flat baffles forming an internal baffle placed inside the hollow semicircularly curved casing, the series of flat baffles peripherally bordered by the hollow semicircularly curved casing and enclosed with side panels forming a labyrinth, an enclosed circuitous pathway of a constantly increasing cross section, the labyrinth subsequently splitting and terminating into an exit port for each split pathway, the side panels together with the hollow semicircularly curved casing forming the enclosure's external walls;

a compression chamber inside the cylindrical top of the semicircularly curved casing behind the driver, the compression chamber having a back open end facing the sloping back semicircular side to allow sound waves coming from the driver to travel down the labyrinth and prevent back waves from reflecting back to the driver;

a base unit having an internal and external side wall and a transverse bottom panel for holding and stabilizing the enclosure;

means for sealing the internal baffle to the side panels and the semicircularly curved casing;

means for sealing the side panels to the semicircularly curved casing;

means for leveling the loudspeaker enclosure; and, means for assembling the entire loudspeaker enclosure together.

2. The loudspeaker of claim 1 wherein the hollow semicircularly curved casing is made of a material selected from the group consisting of fiberglass, metal, wood and plastic material.

3. The loudspeaker of claim 2 wherein the hollow semicircularly curved casing is made of fiberglass.

4. The loudspeaker of claim 1 wherein the semicircularly curved casing has an interior semicircularly shaped walls.

5. The loudspeaker of claim 1 wherein the compression chamber has an adjustable volume.

6. The loudspeaker of claim 1 wherein the compression chamber comprises an inner and an outer cylinder concentric to each other, each having an adjustable thickness and adjustable diameter to reduce the volume of the compression chamber according to a calculated amount.

7. The loudspeaker of claim 6 wherein the inner and outer cylinders are made of polystyrene.

8. The loudspeaker of claim 1 wherein the side panels and base units are made of wood.

9. The loudspeaker of claim 8 wherein the side panels and base units are made of plywood.

10. The loudspeaker of claim 1 wherein the exit ports are covered with cloth wrapped around an armature fitting the exit ports.

11. The loudspeaker of claim 1 wherein the series of flat baffles are interconnected by gluing the joints and reinforcing the joints with nails.

12. The loudspeaker of claim 1 wherein the internal baffle is made of a material selected from the group consisting of medium density fiberboard, plywood and solid wood planks.

13. The loudspeaker of claim 12 wherein the internal baffle is made of medium density fiberboard.

14. The loudspeaker of claim 1 wherein edges of the internal baffle touching and facing the side panels and the semicircularly shaped casing are bordered with polyfoam or rubber gaskets.

15. The loudspeaker of claim 1 further comprising a reflecting piece at each turning point of the semicircularly shaped casing.

16. The loudspeaker of claim 15 wherein the reflecting piece is made of fiberglass.

17. The loudspeaker of claim 1 wherein the enclosure is assembled together by use of tie rods and tie rod cap nuts.

18. The loudspeaker of claim 1 wherein gaskets are placed between the side panels and the semicircularly shaped casing and washers are placed between the side panels and interior side walls of the base unit to produce an air tight seal.

19. The loudspeaker of claim 1 further comprising a rectangular piece of plywood screwed on the internal side wall of the base unit.

20. The loudspeaker of claim 1 further comprising a base connector and a shell support assembly for supporting the base unit and stabilizing the loudspeaker enclosure.

21. The loudspeaker of claim 20 wherein the base connector has studs or pins inserting into openings on the transverse bottom panel of the base unit.

22. The loudspeaker of claim 20 wherein the shell support assembly comprise of a longitudinal rectangular piece having a threaded block on both opposite ends for receiving an adjustable bolt.

23. The loudspeaker of claim 1 further comprising a base level adjuster attached to the base unit for leveling the loudspeaker enclosure.

24. A two coned full range driver having as improvement an add-on third cone having a wider and a narrower end for eliminating intermodulation between the two cones and means for attaching the add-on cone to the full range driver without the add-on cone touching the two cones.

25. The two coned full range driver of claim 24 wherein the add-on cone is attached to the two coned full range driver by an armature having a support rod with a bent tip, the bent tip inserting into an opening of a special bolt supported by a check screw, the special bolt attaching the add-on cone to an acrylic ring attachable to the two coned full range driver whereby the add-on cone is positioned between the two cones without touching the two cones after attachment of the acrylic ring.

26. The two coned full range driver of claim 24 wherein the add-on cone is made of foam rubber or polyfoam with a thickness of no greater than 2 millimeters.

27. The two coned full range driver of claim 24 wherein the add-on cone has a slit on the narrower end of the cone.

* * * * *